US011433407B2

(12) United States Patent
Wu et al.

(10) Patent No.: US 11,433,407 B2
(45) Date of Patent: Sep. 6, 2022

(54) DEVICE FOR GENERATING WATER WITH AIR BUBBLES

(71) Applicant: XIAMEN SOLEX HIGH-TECH INDUSTRIES CO., LTD., Fujian (CN)

(72) Inventors: Shilong Wu, Fujian (CN); Donghai Chen, Fujian (CN); Fengde Lin, Fujian (CN); Bin Cao, Fujian (CN)

(73) Assignee: XIAMEN SOLEX HIGH-TECH INDUSTRIES CO., LTD., Xiamen (CN)

( * ) Notice: Subject to any disclaimer, the term of this patent is extended or adjusted under 35 U.S.C. 154(b) by 0 days.

(21) Appl. No.: 16/914,349

(22) Filed: Jun. 27, 2020

(65) Prior Publication Data

US 2021/0213465 A1 Jul. 15, 2021

(30) Foreign Application Priority Data

Jan. 15, 2020 (CN) ..... 202010041329.8
Jan. 15, 2020 (CN) ..... 202020088389.0

(51) Int. Cl.

| | |
|---|---|
| ***B05B 1/18*** | (2006.01) |
| ***B05B 1/16*** | (2006.01) |
| ***B05B 7/04*** | (2006.01) |
| *A47K 3/28* | (2006.01) |

(52) U.S. Cl.

CPC ..... *B05B 1/18* (2013.01); *B05B 1/1609* (2013.01); *B05B 1/1636* (2013.01); *B05B 7/0425* (2013.01); *A47K 3/28* (2013.01)

(58) Field of Classification Search

CPC ..... B05B 1/18; B05B 1/1609; B05B 1/1636; B05B 7/0425; A47K 3/28

USPC ..... 239/428.5

See application file for complete search history.

(56) References Cited

U.S. PATENT DOCUMENTS 2,998,928 A * 9/1961 Aghnides ..... E03C 1/084 239/428.5
4,365,755 A * 12/1982 Aghnides ..... E03C 1/084 239/428.5

FOREIGN PATENT DOCUMENTS

DE 3335756 A1 4/1985
EP 0631020 A1 12/1994

OTHER PUBLICATIONS

The Extended European Search Report dated Dec. 2, 2020 by the EPO.

* cited by examiner

*Primary Examiner* — Qingzhang Zhou
(74) *Attorney, Agent, or Firm* — Qinghong Xu

(57) ABSTRACT

A bubble water generating device, including: a flow divider, a mixer, an air intake runner, and a water outlet cover the flow divider includes at least one first water inlet hole; a first chamber is formed between the mixer and the flow divider; the mixer includes at least one second water inlet hole corresponding to the at least one first water inlet hole one by one, and at least one return hole; the flow area of each second water inlet hole is greater than that of the corresponding first water inlet hole, the return hole, the first water inlet hole and the second water inlet hole are all communicated with the first chamber; the air intake runner is communicated with the first chamber; a second chamber communicating with the second water inlet hole and the return hole is formed between the water outlet cover and the mixer.

15 Claims, 9 Drawing Sheets

DEVICE FOR GENERATING WATER WITH AIR BUBBLES

CROSS REFERENCE

This application is based upon and claims priority to Chinese Patent Application No. 202010041329.8 and 202020088389.0, filed on Jan. 15, 2020, the entire contents thereof are incorporated herein by reference.

TECHNICAL FIELD

The present disclosure generally relates to the technical field of water outlet devices, and more particularly, to a device for generating water with air bubbles capable of generating micro-bubbles.

BACKGROUND

In the related art, the shower generates water with micro-bubbles by raising the temperature of the water, so that the solubility of the air in the water is reduced, and the bubbles are separated through the expansion holes to obtain micro-bubble water. However, in this method, it is necessary to have a good micro-bubble effect under specific hot water conditions, for the use of normal temperature water, the effect of the shower to generate micro-bubbles is not good.

In the related art, there are some showers that generate micro-bubble water by inhalation. However, the amount of air inflow of this shower does not automatically adjust with the amount of water inflow, or it can only be adjusted manually, resulting in inconvenience in use and poor user experience.

The above information disclosed in the background section is only for enhancing the understanding of the background of the present disclosure, so it may include information that does not constitute related technology known to those of ordinary skill in the art.

SUMMARY

According to one aspect of the disclosure, providing a device for generating water with air bubbles, including: a flow divider, a mixer, an air intake runner and a water outlet cover. The flow divider includes at least one first water inlet hole. A first chamber is formed between the mixer and the flow divider, the mixer comprising at least one second water inlet hole and at least one return hole, and the at least one second water inlet hole corresponds to the at least one first water inlet hole one by one, and a flow area of each second water inlet hole is greater than a flow area of the corresponding first water inlet hole, the at least one return hole, the at least one first water inlet hole, and the at least one second water inlet hole are all communicated with the first chamber. The air intake runner communicated with the first chamber. A second chamber is formed between the water outlet cover and the mixer, and the at least one second water inlet hole and the at least one return hole are both communicated with the second chamber.

According to one embodiment of the present disclosure, the flow divider includes a first disk portion and a cylinder portion, the first disk portion is configured to define a central axis, the flow divider comprises a first surface and a second surface that are opposite to each other, the cylinder portion is configured to extend from the first surface away from the second surface with the central axis as the axis.

According to one embodiment of the present disclosure, there are a plurality of first water inlet holes, the plurality of the first water inlet holes are formed in the first disk portion and are configured to extend through the first surface and the second surface, the plurality of the first water inlet holes are uniformly arranged along a circumferential direction of the first disk portion with the central axis as the center and the plurality of the first water inlet holes are located in an area surrounded by the cylinder portion, the air intake runner is formed in the first disk portion and is configured to extend through the first surface and the second surface and the air intake runner is located outside the area surrounded by the cylinder portion.

According to one embodiment of the present disclosure, the mixer includes a second disk portion and an annular wall portion, the second disk portion is configured to define a central axis, and the second disk portion comprises a third surface and a fourth surface opposite to each other, the annular wall portion is configured to surround a peripheral edge of the second disk portion and protrude from the third surface and the fourth surface.

According to one embodiment of the present disclosure, the flow divider comprises a first disk portion and a cylinder portion, a portion of the annular wall portion protruding from the third surface of the second disk portion is configured to form an accommodating space, after the flow divider and the mixer are assembled, the first disk portion is accommodated in the accommodating space.

According to one embodiment of the present disclosure, the third surface of the second disk portion is configured to be provided with an annular slot, after the flow divider and the mixer are assembled, the annular slot is formed the first chamber.

According to one embodiment of the present disclosure, there are a plurality of second water inlet holes which are formed in the second disk portion and configured to extend through the third surface and the fourth surface, the plurality of second water inlet holes are uniformly arranged along a circumferential direction of the second disk portion with the central axis as the center; there are a plurality of return holes which are formed in the second disk portion and configured to extend through the third surface and the fourth surface, the plurality of return holes are uniformly arranged along the circumferential direction of the second disk portion with the central axis as the center.

According to one embodiment of the present disclosure, the plurality of return holes are closer to the central axis than the plurality of second water inlet holes.

According to one embodiment of the present disclosure, the device for generating water with air bubbles further includes: a filter screen assembly disposed in the second chamber.

According to one embodiment of the present disclosure, the filter screen assembly comprises a plurality of first filter screens and a plurality of second filter screens, the plurality of first filter screens and the plurality of second filter screens are alternately stacked, and a mesh number of each of the first filter screens is different from that of each of the second filter screens.

According to one embodiment of the present disclosure, the device for generating water with air bubbles further includes: a plurality of locking members for connecting the flow divider and the mixer.

According to one embodiment of the present disclosure, the flow divider comprises a plurality of through holes, and the mixer comprises a plurality of connecting posts which are configured to protrude from a surface of the mixer facing away from the flow divider, the plurality of through holes are configured to correspond to the plurality of connecting posts one by one, and the plurality of locking members are respectively connected to the plurality of connecting posts by extending through the plurality of through holes.

According to one embodiment of the present disclosure, the device for generating water with air bubbles is a shower or a bubbler.

According to one embodiment of the present disclosure, the air intake runner is formed on the flow divider; or, the air intake runner is formed between the flow divider and the water outlet cover.

BRIEF DESCRIPTION OF THE DRAWINGS

The above and other features and advantages of the present disclosure will become more apparent by describing in detail exemplary embodiments thereof with reference to the drawings.

DETAILED DESCRIPTION

Figure 1:
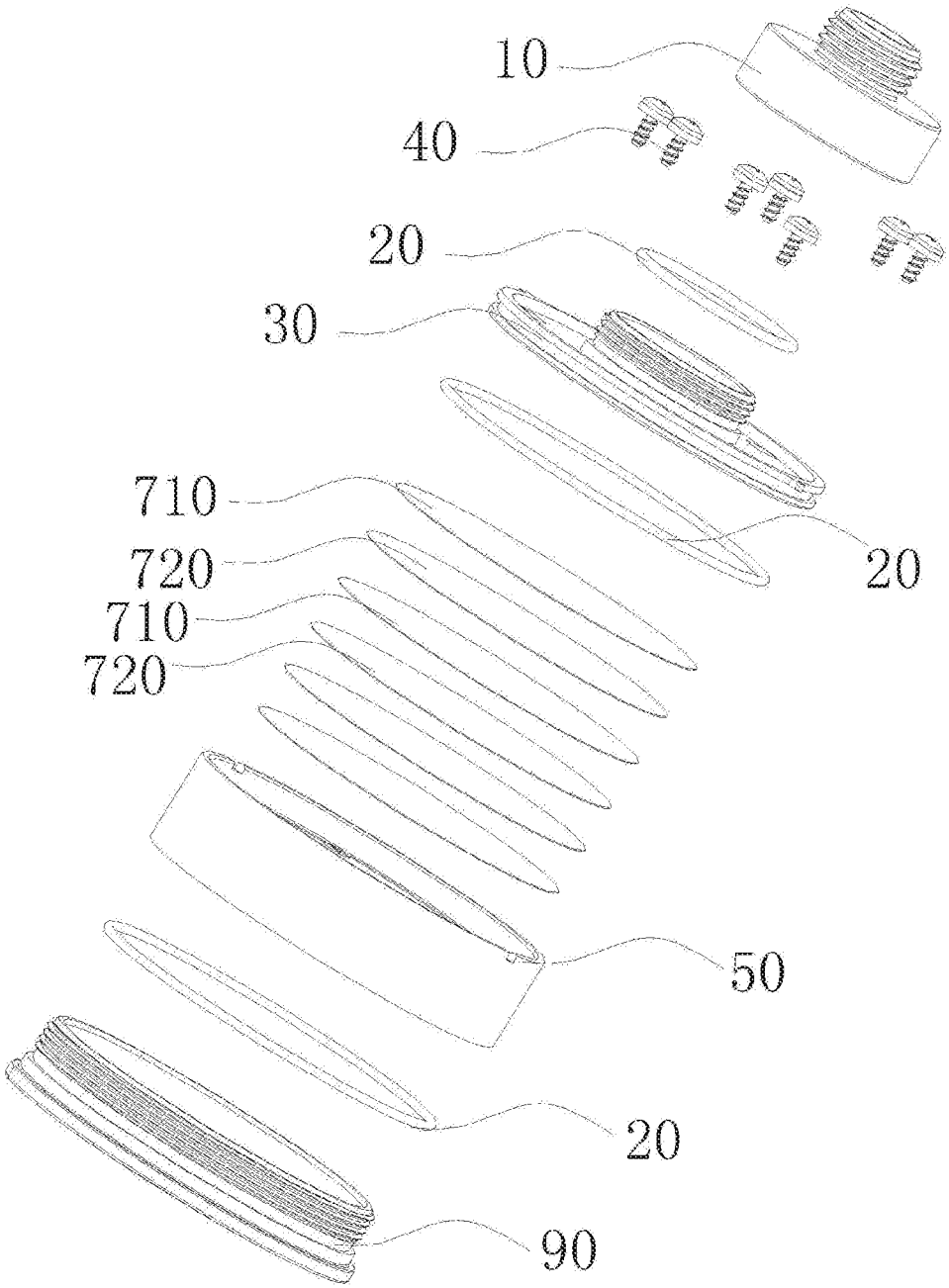
FIG. 1 is an exploded view of a device for generating water with air bubbles of an exemplary embodiment of the present disclosure.

Exemplary embodiments will now be described more fully with reference to the drawings. However, the exemplary embodiments can be implemented in various forms and should not be construed as being limited to the embodiments set forth herein; rather, these embodiments are provided so that the present disclosure will be comprehensive and complete, and will fully convey the concept of exemplary embodiments to those skilled in the art. The same reference numerals in the drawings denote the same or similar structures, and thus their detailed description will be omitted.

Although relative terms are used in this specification, such as "upper" and "lower" to describe the relative relationship of one component to another component shown in the drawings, these terms are used in this specification only for convenience, for example, according to the direction of the example described in the drawing. It can be understood that if the device showing in the drawing is turned upside down, then the described component located at "upper" will become the component located at "lower". Other relative terms, such as "top" and "bottom" have similar meanings. The terms "one", "a", "the" and "said" are used to indicate the presence of one or more elements/components/etc.; the terms "include" and "have" are intended to mean an open-ended inclusion and mean that there can be additional elements/components/and the like in addition to the listed elements/components/etc.; the terms "first", "second". "third", and "fourth" are only used as marks, not to limit the number of objects.

The inventor of the present disclosure discovered in the research that there are some devices for generating water with air bubbles in the related art, which suck air into the device for generating water with air bubbles by air suction and mix the air with water, then form a water flow with bubbles, and eventually generate the water with bubbles. However, the effect of the bubble water generated by this device for generating water with air bubbles is not good. The inventors of the present disclosure found that because this kind of device for generating water with air bubbles does not control the amount of air inflow well, excessive inhalation of air causes large bubbles in the water flow, and does not form high-density micro-bubbles, resulting in a poor user experience.

Based on this, the present disclosure provides a device for generating water with air bubbles, including a flow divider, a mixer, an air intake runner, and a water outlet cover, the flow divider includes at least one first water inlet hole; a first chamber is formed between the mixer and the flow divider, the mixer includes at least one second water inlet hole and at least one return hole, the at least one second water inlet hole corresponds to the at least one first water inlet hole one by one, and the flow area of each second water inlet hole is greater than the flow area of the corresponding first water inlet hole, the at least one return hole, the at least one first water inlet hole, and the at least one second water inlet hole are all communicated with the first chamber; the air intake runner is communicated with the first chamber; a second chamber is formed between the water outlet cover and the mixer, and the at least one second water inlet hole and the at least one return hole are both communicated with the second chamber.

The water flows through the first water inlet hole and the second water inlet hole in sequence, because the flow area of the second water inlet hole is larger than that of the first water inlet hole, a certain negative pressure will be generated in the second water inlet hole according to Bernoulli's principle, so that the outside air will pass through the air intake runner and the first chamber in sequence to be sucked into the second water inlet hole, and form a mixed water flow with certain bubbles, after the mixed water flow enters the second chamber, a part of the mixed water flow returns to the first chamber through the return hole, and then is sucked into the second water inlet hole, so that it circulates back and forth. Because part of the returned mixed water flow fills the first chamber during the reciprocating cycle, it prevents the outside air from being sucked into the device which is used to generate water with air bubbles, and plays a role in reducing the amount of air inflow, as this part of the mixed water flow is sucked into the second water inlet hole again, when the first chamber is not filled with the mixed water flow, the outside air continues to be sucked, thereby achieving the effect of automatically controlling the amount of the air inflow of the outside air. At the same time, because the amount of air inflow of the outside air is effectively controlled, the bubbles in the mixed water flow with certain bubbles are small, and the device for generating water with air bubbles can generate bubble water with micro-bubbles.

The structure, connection manner, and functional relationship of the main components of the device for generating water with air bubbles proposed in the present disclosure will be described in detail below in conjunction with the drawings.

It should be understood that the "connection" in the present disclosure may be an embodiment of direct contact with another component or components, and may also include an embodiment in which additional feature components can be inserted.

Figure 2:
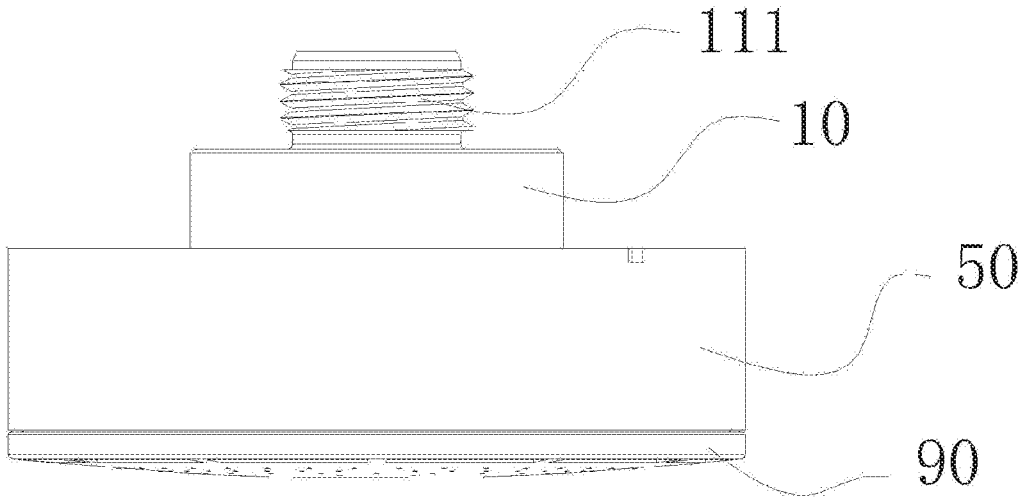
FIG. 2 is a side view of a device for generating water with air bubbles of an exemplary embodiment of the present disclosure.
Figure 3:
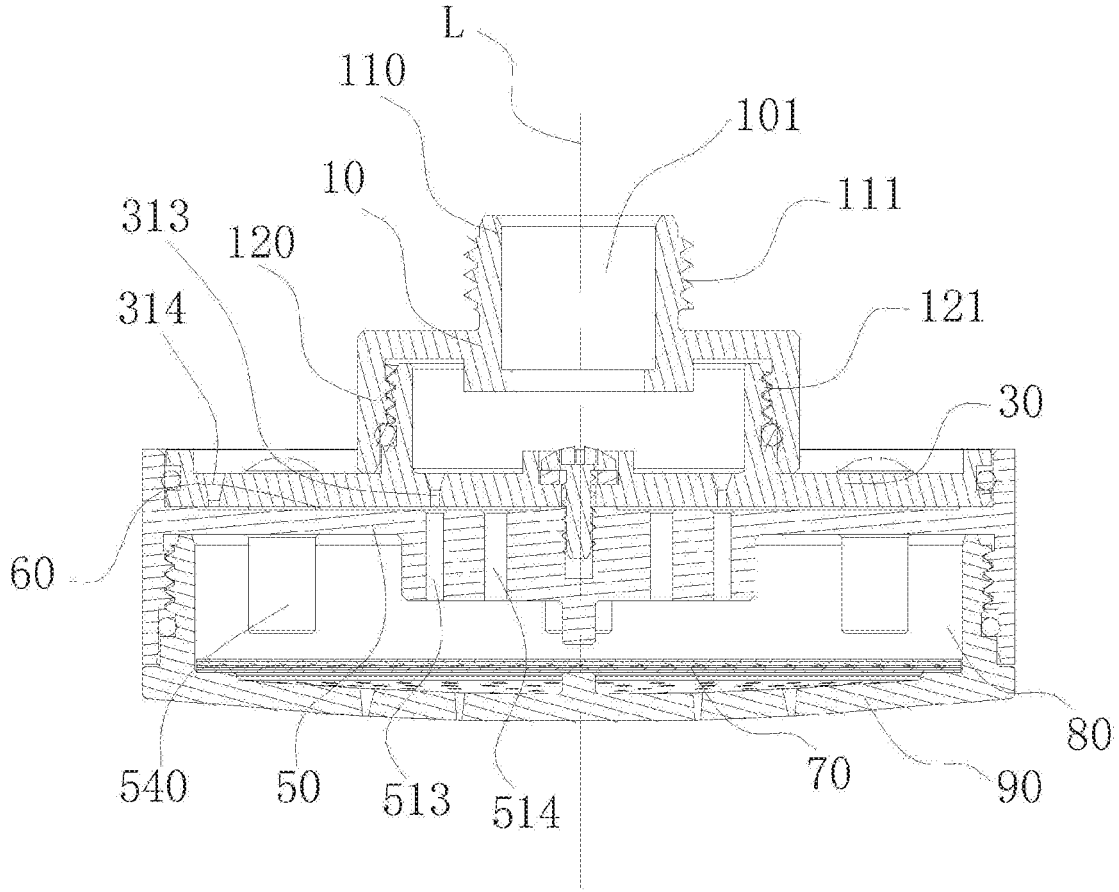
FIG. 3 is a cross-sectional view of a device for generating water with air bubbles of an exemplary embodiment of the present disclosure.

As shown in FIGS. 1 to 3, FIG. 1 is an exploded view of a device for generating water with air bubbles of an exemplary embodiment of the present disclosure, FIG. 2 is a side view of a device for generating water with air bubbles of an exemplary embodiment of the present disclosure, FIG. 3 is a cross-sectional view of a device for generating water with air bubbles of an exemplary embodiment of the present disclosure, in an exemplary embodiment, the device for generating water with air bubbles of the present disclosure may be a shower, the cutting plane of the FIG. 3 is cut along the axis of the shower. In an example embodiment, the device for generating water with air bubbles provided by the present disclosure may be a shower. The device for generating water with air bubbles includes a water inlet assembly 10, a flow divider 30, a mixer 50, a filter screen assembly 70 and a water outlet cover 90.

As shown in FIG. 3, the water inlet assembly 10 is connected to the flow divider 30, the flow divider 30 is connected to the mixer 50, and the water outlet cover 90 is connected to the mixer 50, a second chamber 80 is formed between the water outlet cover 90 and the mixer 50, the filter screen assembly 70 is disposed in the second chamber 80 and is close to the water outlet cover 90.

The water inlet assembly 10 includes a first ring portion 110 and a second ring portion 120, the first ring portion 110 and the second ring portion 120 together form a water intake runner 101, the first ring portion 110 is provided with a first external thread 111 on the outside, the first external thread 111 is used to connect with a water inlet pipe (not shown) or other components that provide a water source, the second ring portion 120 is provided with an internal thread 121 for screw connection with the flow divider 30. A sealing ring 20 is also provided at the connection position between the second ring portion 120 and the flow divider 30 to prevent water leakage from the connection position between the two.

Figure 4:
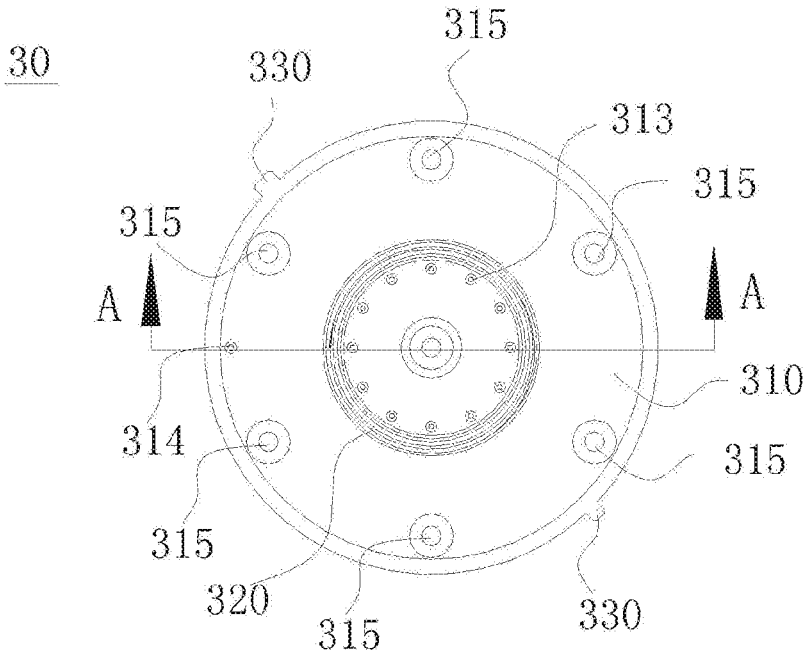
FIG. 4 is a plan view of a flow divider of the device for generating water with air bubbles of an exemplary embodiment of the present disclosure.
Figure 5:
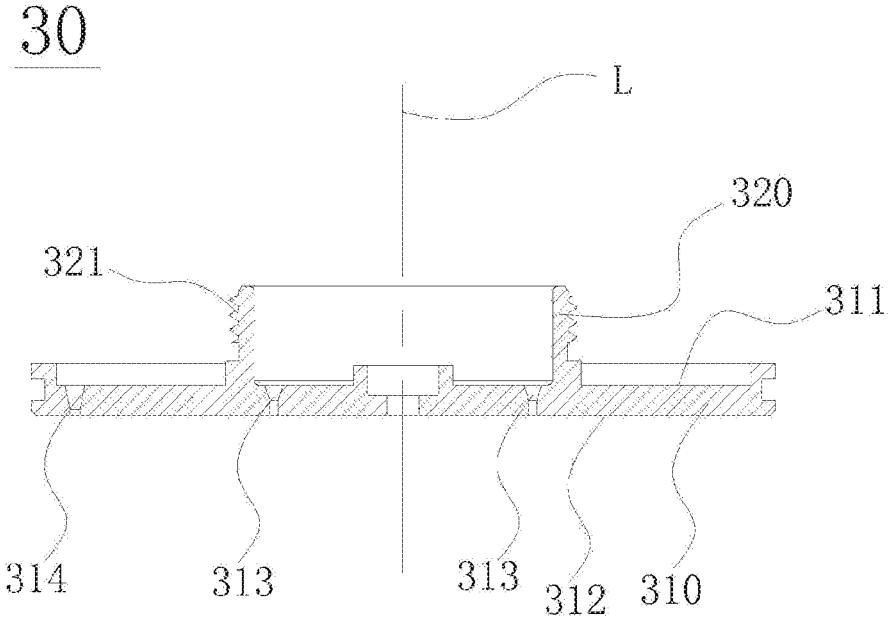
FIG. 5 is a cross-sectional view taken along line A-A in FIG. 4.

As shown in FIGS. 4 and 5, FIG. 4 is a plan view of a flow divider of the device for generating water with air bubbles of an exemplary embodiment of the present disclosure, FIG. 5 is a cross-sectional view taken along line A-A in FIG. 4. In an exemplary embodiment, the flow divider 30 includes a first disk portion 310 and a cylinder portion 320, the first disk portion 310 defines a central axis L, the flow divider 30 includes a first surface 311 and a second surface 312 that are opposite to each other, the cylinder portion 320 is perpendicular to the first disk portion 310 and extends from the first surface 311 away from the second surface 312 with the central axis L as the axis, the outer portion of the cylinder portion 320 has a second external thread 321 for screw connection with the water inlet assembly 10.

The flow divider 30 includes a plurality of first water inlet holes 313 and an air intake runner 314, and the plurality of first water inlet holes 313 communicate with the water intake runner 101. The plurality of the first water inlet holes 313 are formed in the first disk portion 310 and extend through the first surface 311 and the second surface 312, the plurality of the first water inlet holes 313 are uniformly arranged along the circumferential direction of the first disk portion 310 with the central axis L as the center and the plurality of the first water inlet holes 313 are located in the area surrounded by the cylinder portion 320, the air intake runner 314 is formed in the first disk portion 310 and extends through the first surface 311 and the second surface 312 and the air intake runner 314 is located outside the area surrounded by the cylinder portion 320.

Figure 6:
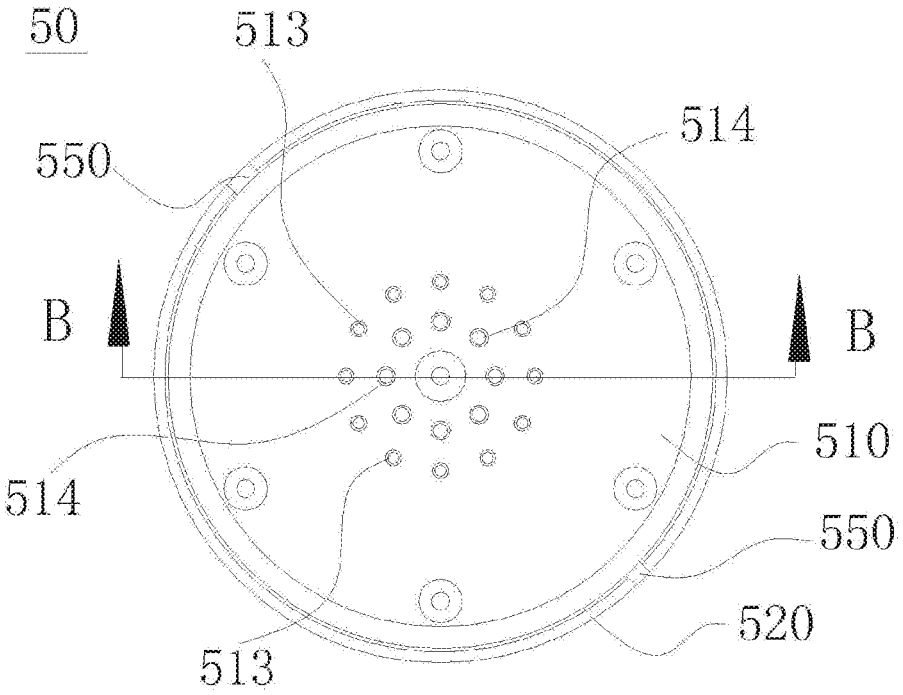
FIG. 6 is a plan view of a mixer of the device for generating water with air bubbles of an exemplary embodiment of the present disclosure.
Figure 7:
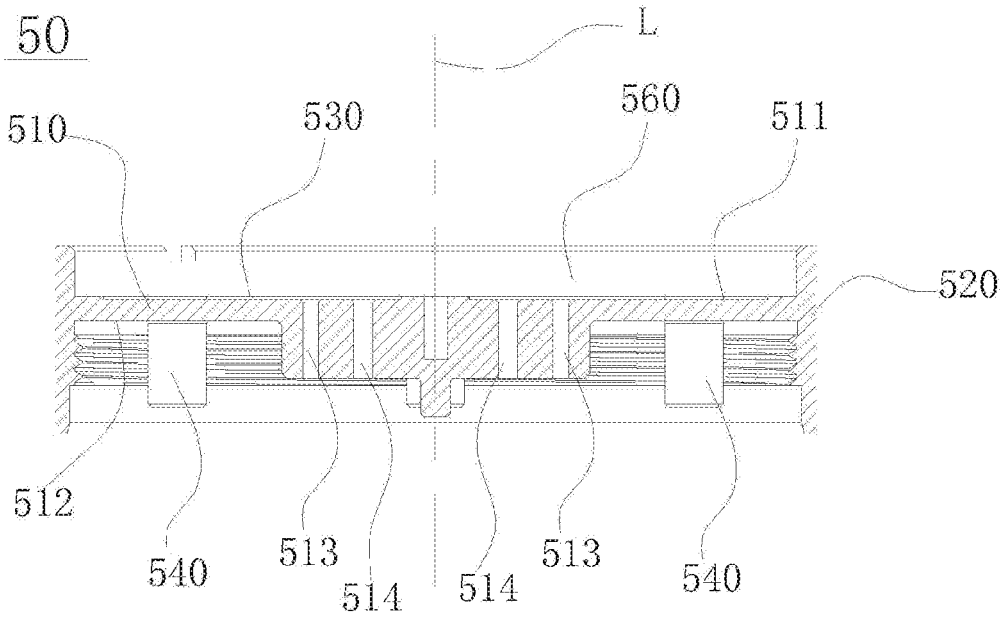
FIG. 7 is a cross-sectional view taken along line B-B in FIG. 6.

As shown in FIGS. 6 and 7, FIG. 6 is a plan view of a mixer of the device for generating water with air bubbles of an exemplary embodiment of the present disclosure, FIG. 7 is a cross-sectional view taken along line B-B in FIG. 6. In one exemplary embodiment, the mixer 50 includes a second disk portion 510 and an annular wall portion 520, the second disk portion 510 defines a central axis L, and includes a third surface 511 and a fourth surface 512 opposite to each other, the annular wall portion 520 surrounds the peripheral edge of the second disk portion 510 and protrudes from the third surface 511 and the fourth surface 512. After the flow divider 30 and the mixer 50 are assembled, the central axis L defined by the first disk portion 310 are coincided with the central axis L defined by the second disk portion 510.

The mixer 50 includes a plurality of second water inlet holes 513 and a plurality of return holes 514, the plurality of second water inlet holes 513 are formed in the second disk portion 510 and extend through the third surface 511 and the fourth surface 512, the plurality of second water inlet holes 513 are uniformly arranged along the circumferential direction of the second disk portion 510 with the central axis L as the center, the plurality of return holes 514 are formed in the second disk portion 510 and extend through the third surface 511 and the fourth surface 512, the plurality of return holes 514 are uniformly arranged along the circumferential direction of the second disk portion 510 with the central axis L as the center.

As shown in FIG. 3, when the flow divider 30 and the mixer 50 are assembled, the plurality of second water inlet holes 513 correspond to the plurality of first water inlet holes 313 one by one, and the flow area of each second water inlet hole 513 is larger than the flow area of the corresponding first water inlet hole 313. When the water flow enters the shower and flows through the water intake runner 101, the first water inlet holes 313 and the second water inlet holes 513 in sequence, since the flow area of the second water inlet hole 513 is larger than that of the first water inlet hole 313, according to Bernoulli's principle, a certain negative pressure will be generated in the second water inlet holes 513, so that the outside air is sucked into the shower from the air intake runner 314.

Please continue to refer to FIG. 7, the third surface 511 of the mixer 50 is provided with an annular slot 530, the portion of the annular wall portion 520 protruding from the third surface 511 of the second disk portion 510 forms an accommodating space 560. After the flow divider 30 and the mixer 50 are assembled, the disk portion 310 of the flow divider 30 is accommodated in the accommodating space 560, and at the same time, the second surface 312 of the first disk portion 310 is fit to the third surface 511 of the second disk portion 510, due to the existence of the annular slot 530, a first chamber 60 as shown in FIG. 3 is formed between the flow divider 30 and the mixer 50.

As shown in FIG. 3, the air intake runner 314, the plurality of return holes 514, the plurality of first water inlet holes 313, and the plurality of second water inlet holes 513 are all communicated with the first chamber 60, and the plurality of return holes 514 and the plurality of first water inlet holes 313 are misaligned with each other. After the outside air is sucked in the device from the air intake runner 314, the air passes through the first chamber 60 and the second water inlet holes 513 in sequence, and forms a mixed water flow with certain bubbles with the water flow, after the mixed water flow enters the second chamber 80, a part of the mixed water flow returns to the first chamber 60 through the return holes 514, and then is sucked into the second water inlet holes 513, so that it circulates back and forth.

Because part of the returned mixed water flow fills the first chamber 60 during the reciprocating cycle, it prevents the outside air from being sucked into the shower, and plays a role in reducing the amount of air inflow, as this part of the mixed water flow is sucked into the second water inlet holes 513 again, when the first chamber 60 is not filled with the mixed water flow, the outside air continues to be sucked into the shower, thereby achieving the effect of automatically controlling the amount of the air inflow of the outside air. At the same time, because the amount of air inflow of the outside air is effectively controlled, the bubbles in the mixed water flow with certain bubbles are small, and the shower can generate bubble water with micro-bubbles.

Please continue to refer to FIGS. 6 and 7, in an exemplary embodiment, the plurality of return holes 514 of the mixer 50 are closer to the central axis L than the plurality of second water inlet holes 513, in other words, the radius of the circle formed by the plurality of return holes 514 uniformly distributed along the circumferential direction of the second disk portion 510 is smaller than the radius of the circle formed by the plurality second water inlet holes 513 uniformly distributed along the circumferential direction of the second disk portion 510.

Through such a design, taking the second water inlet hole 513 and the return hole 514 on the left side of the central axis L in FIG. 3 as an example, part of the returned mixed water flow circulates through the return hole 514, the first chamber 60, the second water inlet hole 513 and the second chamber 80 and has a circulation direction of counterclockwise, the flow direction of the outside air enters into the second water inlet hole 513 from the air intake runner 314 is exactly opposite to the circulation direction. According to this, the part of returned mixed water flow better prevents the outside air from being sucked into the shower during the circulation process, and finally achieves the effect of automatically controlling the amount of air inflow of the outside air.

As shown in FIGS. 3, 4 and 6, the shower also includes a plurality of locking members 40 for connecting the flow divider 30 and the mixer 50. In one embodiment, the locking member 40 may be a screw.

The flow divider 30 includes a plurality of through holes 315, and the mixer 50 includes a plurality of connecting posts 540 which protrude from the fourth surface 512 of the second disk portion 510 of the mixer 50 and extend toward the water outlet cover 90, the plurality of through holes 315 correspond to the plurality of connecting posts 540 one by one, and the plurality of locking members 40 are respectively connected to the plurality of connecting posts 540 by extending through the plurality of through holes 315.

In addition, the ends of the plurality of connecting posts 540 far away from the flow divider 30 are close to the filter screen assembly 70 to prevent the filter screen of the filter screen assembly 70 from wrinkling and so as to make the filter screen smoother.

Of course, in other embodiments, other suitable connection manners may also be used to connect the flow divider 30 and the mixer 50, which will not be described in detail here.

Please continue to refer to FIG. 3, the water outlet cover 90 is detachably connected to the annular wall portion 520 of the mixer 50, for example, through a threaded connection, so that the water outlet cover 90 can be removed at any time to clean the shower, such as cleaning the filter screen assembly 70. A sealing ring 20 is also provided between the water outlet cover 90 and the mixer 50 to prevent water leakage from the connection position between the two.

As shown in FIGS. 1 and 3, a second chamber 80 is formed between the water outlet cover 90 and the mixer 50, and the plurality of second water inlet holes 513 and the plurality of return holes 514 are communicated with the second chamber 80. The shower also includes a plurality of stacked filter screens, and the plurality of filter screens are disposed in the second chamber 80.

The outside air is sucked in the shower and then mixed with the water flow to form a water flow with bubbles, after the water flow with bubbles flows through the second water inlet holes 513, the water flow flows into the second chamber 80, and a part of the water flow returns to the first chamber 60 through the return holes 514, which will not be repeated here. Another part of the gas-water mixture passes through the filter screen assembly 70, and the larger bubbles are cut into tiny bubbles by the filter screen, so that the water flow finally out of the water outlet cover 90 has micro-bubbles to generate bubble water with good effect.

As shown in FIG. 1, the plurality of filter screens includes a plurality of first filter screens 710 and a plurality of second filter screens 720, the plurality of first filter screens 710 and the plurality of second filter screens 720 are alternately stacked, and the mesh number of the first filter screen 710 is different from that of the second filter screen 720. For example, the first filter screen 710 may be a filter screen with sparse holes, the second filter screen 720 may be a filter screen with dense holes, the plurality of first filter screens 710 and the plurality of second filter screens 720 are alternately stacked to form a sparse and dense alternating filter screen assembly 70, so that the effect of cutting air bubbles is optimal.

As shown in FIGS. 4 and 6, in one embodiment, the first disk portion 310 of the flow divider 30 is provided with a positioning protrusion 330, and the mixer 50 is provided with a positioning notch 550 that cooperates with the positioning protrusions 330. When the flow divider 30 and the mixer 50 are assembled, through the cooperation of the positioning protrusion 330 and the positioning notch 550, the two can be easily assembled, so that the first water inlet hole 313 and the second water inlet hole 513 are quickly and conveniently aligned, and the assembly efficiency is improved.

Of course, in other embodiments, the positioning protrusion 330 may also be provided on the mixer 50, and the positioning notch 550 is provided on the flow divider 30. Alternatively, assembly positioning can be achieved through other suitable positioning structures, which are not listed here one by one.

Another exemplary embodiment of the device for generating water with air bubbles of the present disclosure may also be a bubbler.

Figure 8:
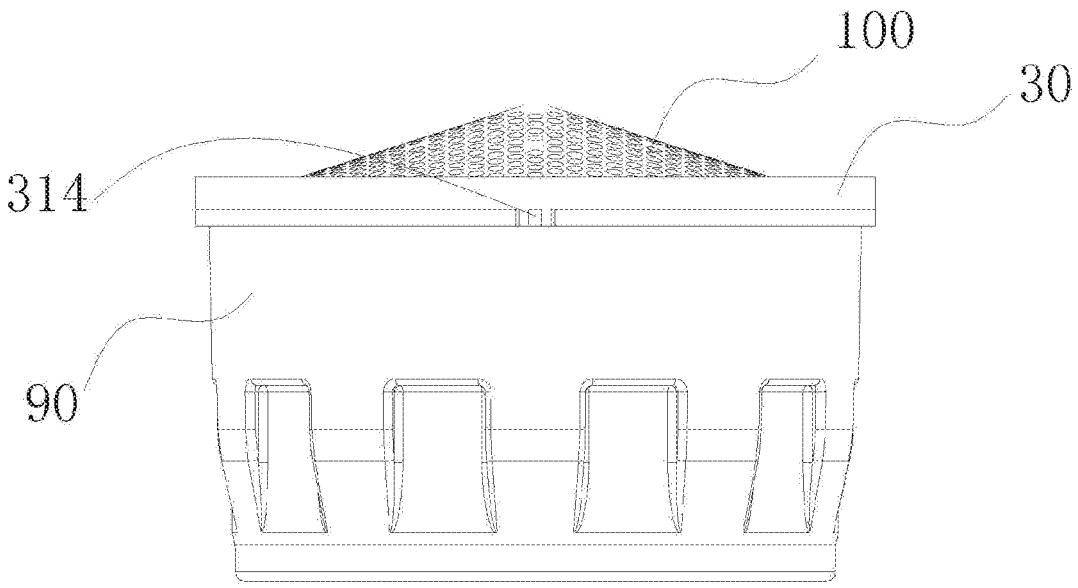
FIG. 8 is a side view of a device for generating water with air bubbles of another exemplary embodiment of the present disclosure.
Figure 9:
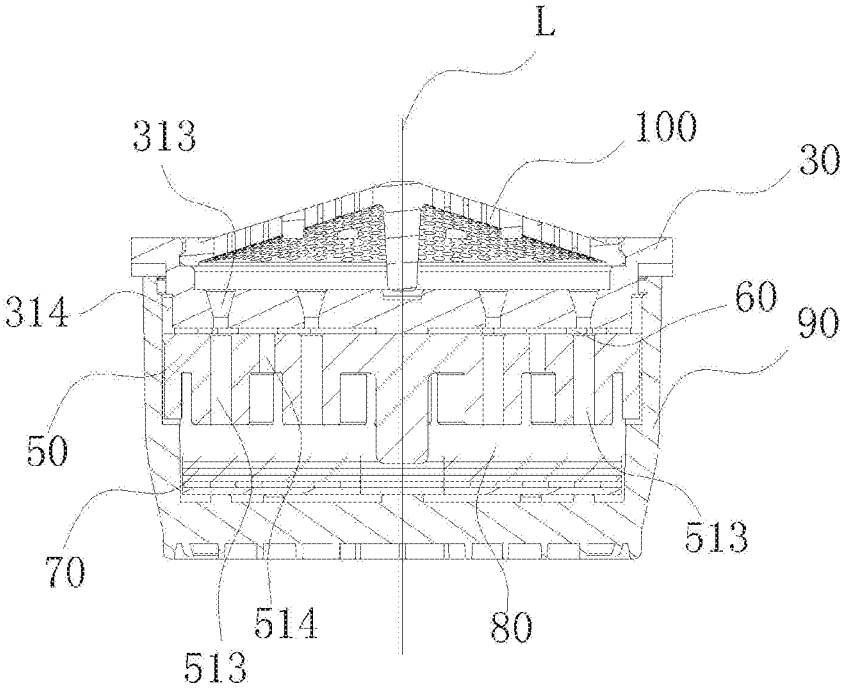
FIG. 9 is a cross-sectional view of a device for generating water with air bubbles of another exemplary embodiment of the present disclosure.

As shown in FIGS. 8 and 9. FIG. 8 is a side view of a device for generating water with air bubbles of another exemplary embodiment of the present disclosure, FIG. 9 is a cross-sectional view of a device for generating water with air bubbles of another exemplary embodiment of the present disclosure. The difference between this embodiment and the above described shower embodiment is as follows.

The bubbler includes a filter component 100, a flow divider 30, a mixer 50, a filter screen assembly 70, and a water outlet cover 90. The water outlet cover 90 is fastened to the mixer 50 and the flow divider 30, and a second chamber 80 is formed between the water outlet cover 90 and the mixer 50, and the filter screen assembly 70 is disposed in the second chamber 80. An air intake runner 314 is formed between the side wall of the water outlet cover 90 and the side wall of the flow divider 30, and the air intake runner 314 communicates with the first chamber 60.

When the water flow passes through the filter component 100, the first water inlet hole 313 and the second water inlet hole 513 in sequence, because the flow area of the second water inlet hole 513 is larger than the flow area of the first water inlet hole 313, according to Bernoulli's principle, a certain negative pressure will be generated in the second water inlet hole 513, so that the outside air is sucked into the bubbler from the air intake runner 314. The principle of generating micro-bubbles in the bubbler is basically the same as the embodiment of the above described shower, which will not be repeated here.

Of course, in other embodiments, the air intake runner may also be formed on the flow divider or other suitable components/locations.

In summary, the advantages and beneficial effects of the device for generating water with air bubbles of the present disclosure are as follows.

The water flows through the first water inlet hole 313 and the second water inlet hole 314 in sequence, because the flow area of the second water inlet hole 513 is larger than that of the first water inlet hole 313, according to Bernoulli's principle, a certain negative pressure will be generated in the second water inlet hole 513, so that the outside air will pass through the air intake runners 314 and the first chamber 60 in order to be sucked into the second water inlet hole 513, and form a mixed water flow with certain bubbles, after the mixed water flow enters the second chamber 80, a part of the mixed water flow returns to the first chamber 61 through the return hole 514, and then is sucked into the second water inlet hole 513, so that it circulates back and forth. Because part of the returned mixed water flow fills the first chamber 60 during the reciprocating cycle, it prevents the outside air from being sucked into the device for generating water with air bubbles, and plays a role in reducing the amount of air inflow, as this part of the mixed water flow is sucked into the second water inlet hole 513 again, when the first chamber 60 is not filled with the mixed water flow, the outside air continues to be sucked, thereby achieving the effect of automatically controlling the amount of the air inflow of the outside air. At the same time, because the amount of air inflow of the outside air is effectively controlled, the bubbles in the mixed water flow with certain bubbles are small, and the device for generating water with air bubbles can generate bubble water with micro-bubbles.

In addition, the bubbles in the bubble water generated by the device for generating water with air bubbles of the present disclosure can reach the micron level, and the size is smaller than the pores of the human body, so that when the user is showering or washing, the bubbles can enter the pores for thorough cleaning. Moreover, because the water contains uniform air bubbles, it can also reduce the impact of the water sprayed from the shower, so that the shower will be more gentle.

It should be noted here that the device for generating water with air bubbles shown in the drawings and described in this specification is only an example that adopts the principles of the present disclosure. Those of ordinary skill in the art should clearly understand that the principles of the present disclosure are not limited to any details or any components of the device shown in the drawings or described in the specification.

It should be understood that this disclosure does not limit its application to the detailed structure and arrangement of the components proposed in this specification. The present disclosure can have other embodiments, and can be implemented and executed in various manners. The aforementioned modified manners and modified manners fall within the scope of the present disclosure. It should be understood that the disclosure disclosed and defined in this specification extends to all alternative combinations of two or more individual features mentioned or evident in the text and/or drawings. All of these different combinations constitute various alternative aspects of the present disclosure. The embodiments described in this specification illustrate the best modes known for implementing the present disclosure, and will enable those skilled in the art to utilize the present disclosure.

What is claimed is:

1. A device for generating water with air bubbles, comprising:

a flow divider, comprising at least one first water inlet hole;

a mixer, wherein a first chamber is formed between the mixer and the flow divider, the mixer comprising at least one second water inlet hole and at least one return hole, and the at least one second water inlet hole and the at least one first water inlet hole are in a one-to-one correspondence, and a flow area of each the second water inlet hole is greater than a flow area of the first water inlet hole corresponding to the second water inlet hole, the at least one return hole, the at least one first water inlet hole, and the at least one second water inlet hole are all communicated with the first chamber;

an air intake runner communicated with the first chamber, the air intake runner is configured to input an outside air into the first chamber to mix with the water flow to form a mixed water with bubbles; and a water outlet cover, wherein a second chamber is formed between the water outlet cover and the mixer, and the at least one second water inlet hole and the at least one return hole are both communicated with the second chamber;

wherein the second chamber is configured to receive the mixed water flowing from the second water inlet hole, and the return hole is configured to flow the mixed water into the first chamber.

2. The device for generating water with air bubbles according to claim 1, wherein the flow divider comprises a first disk portion and a cylinder portion, the first disk portion is configured to define a central axis, the flow divider comprises a first surface and a second surface that are opposite to each other, the cylinder portion is configured to extend from the first surface away from the second surface along the central axis.

3. The device for generating water with air bubbles according to claim 2, wherein there are a plurality of first water inlet holes, the plurality of the first water inlet holes are formed in the first disk portion and are configured to extend through the first surface and the second surface, the plurality of the first water inlet holes are uniformly arranged along a circumferential direction of the first disk portion with the central axis as the center and the plurality of the first water inlet holes are located in an area surrounded by the cylinder portion, the air intake runner is formed in the first disk portion and is configured to extend through the first surface and the second surface and the air intake runner is located outside the area surrounded by the cylinder portion.

4. The device for generating water with air bubbles according to claim 1, wherein the mixer comprises a second disk portion and an annular wall portion, the second disk portion is configured to define a central axis, and the second disk portion comprises a third surface and a fourth surface opposite to each other, the annular wall portion is configured to surround a peripheral edge of the second disk portion and protrude from the third surface and the fourth surface.

5. The device for generating water with air bubbles according to claim 4, wherein the flow divider comprises a first disk portion and a cylinder portion, a portion of the annular wall portion protruding from the third surface of the second disk portion is configured to form an accommodating space, after the flow divider and the mixer are assembled, the first disk portion is accommodated in the accommodating space.

6. The device for generating water with air bubbles according to claim 4, wherein the third surface of the second disk portion is configured to be provided with an annular slot, after the flow divider and the mixer are assembled, the annular slot is formed the first chamber.

7. The device for generating water with air bubbles according to claim 4, wherein there are a plurality of second water inlet holes which are formed in the second disk portion and configured to extend through the third surface and the fourth surface, the plurality of second water inlet holes are uniformly arranged along a circumferential direction of the second disk portion with the central axis as the center; there are a plurality of return holes which are formed in the second disk portion and configured to extend through the third surface and the fourth surface, the plurality of return holes are uniformly arranged along the circumferential direction of the second disk portion with the central axis as the center.

8. The device for generating water with air bubbles according to claim 7, wherein the plurality of return holes are closer to the central axis than the plurality of second water inlet holes.

9. The device for generating water with air bubbles according to claim 1, further comprises:

a filter screen assembly disposed in the second chamber.

10. The device for generating water with air bubbles according to claim 9, wherein the filter screen assembly comprises a plurality of first filter screens and a plurality of second filter screens, the plurality of first filter screens and the plurality of second filter screens are alternately stacked, and a mesh number of each of the first filter screens is different from that of each of the second filter screens.

11. The device for generating water with air bubbles according to claim 1, further comprises:

a plurality of screws for connecting the flow divider and the mixer.

12. The device for generating water with air bubbles according to claim 11, wherein the flow divider comprises a plurality of through holes, and the mixer comprises a plurality of connecting posts which are configured to protrude from a surface of the mixer facing away from the flow divider, the plurality of through holes are configured to correspond to the plurality of connecting posts one by one, and the plurality of screws are respectively connected to the plurality of connecting posts by extending through the plurality of through holes.

13. The device for generating water with air bubbles according to claim 1, wherein the device for generating water with air bubbles is a shower or a bubbler.

14. The device for generating water with air bubbles according to claim 1, wherein the air intake runner is formed on the flow divider.

15. The device for generating water with air bubbles according to claim 1, wherein the air intake runner is formed between the flow divider and the water outlet cover.

* * * * *